United States Patent [19]

Larsen

[11] Patent Number: 4,462,324

[45] Date of Patent: Jul. 31, 1984

[54] BOBBIN AND PLUNGER ASSEMBLY

[75] Inventor: Robert H. Larsen, Middletown, N.J.

[73] Assignee: The Singer Company, Stamford, Conn.

[21] Appl. No.: 549,029

[22] Filed: Nov. 7, 1983

[51] Int. Cl.[3] ..... D05B 59/00

[52] U.S. Cl. ..... 112/279; 242/18 R; 242/118.4

[58] Field of Search ..... 112/279, 181, 184, 186, 112/228, 229, 231; 242/118.4, 18 R

[56] References Cited

U.S. PATENT DOCUMENTS 4,216,733 8/1980 Kornatowski ..... 112/184

4,326,474 4/1982 Zylbert .

*Primary Examiner*—Peter P. Nerbun

*Attorney, Agent, or Firm*—William V. Ebs; Robert E. Smith; Edward L. Bell

[57] ABSTRACT

A one-piece plunger with a control button at one end and a driving paddle at the other end is located in a one-piece sewing machine bobbin. The bobbin is provided with crossed slots, one of which normally has the paddle therein and which is dead ended to provide a stop limiting spring biased upward movement of the plunger in the bobbin, the other slot being open ended to permit the paddle to be moved therethrough during assembly of the plunger in the bobbin.

4 Claims, 8 Drawing Figures

BOBBIN AND PLUNGER ASSEMBLY

DESCRIPTION

BACKGROUND OF THE INVENTION

The invention relates to sewing machine bobbins and, more particularly, to sewing machine bobbins as adapted for use in connection with bobbin driving mechanism.

DESCRIPTION OF THE PRIOR ART

A bobbin as used in the bobbin winding system of U.S. Pat. No. 4,326,474 of The Singer Company for "In-Place Bobbin Winding Mechanism for a Sewing Machine", issued Apr. 27, 1982, carries a driving plunger which is axially disposed for rotation by mechanism of the machine when thread is to be wound on the bobbin. In order to locate such a plunger in a one-piece bobbin it has been necessary either to manufacture a multipart plunger and assemble the pieces in the bobbin, or to produce a multipart bobbin and assemble the bobbin parts about a one-piece plunger. However, neither method of construction has been cost effective.

It is an object of the present invention to provide an low cost construction for a thread winding bobbin and bobbin driving plunger assembly.

It is another object of the invention to provide an improved construction for a thread winding bobbin and bobbin driving plunger permitting the bobbin and plunger to be formed as one-piece structures.

Other objects and advantages of the invention will become apparent during a reading of the specification taken in connection with the accompanying drawings.

SUMMARY OF THE INVENTION

A bobbin and plunger assembly for use in the bobbin winding system of a sewing machine is provided with a one-piece bobbin and one-piece plunger. The plunger includes a cylindrical shaft with a control button at one end and a flat bobbin driving paddle at the other end. The bobbin includes an intermediate section with a cylindrical through opening wherein the shaft is supported, a topside button accommodating recess which communicates with the said through opening and wherein a spring acts to bias the plunger upwardly in the bobbin, and a pair of crossed slots which extend upwardly from the bottom side of the bobbin. One of the crossed slots has the paddle therein and is dead ended to provide a stop limiting upward movement of the plunger. The other crossed slot is formed to extend from the bottom of the bobbin to the button accommodating recess and permit the plunger to be assembled in the bobbin with an accompanying movement of the paddle down through said other slot to a position below the bobbin from which the paddle can be turned into alignment with, and caused by, the spring to snap into the said one slot.

DESCRIPTION OF THE PREFERRED EMBODIMENT

Figure 1:
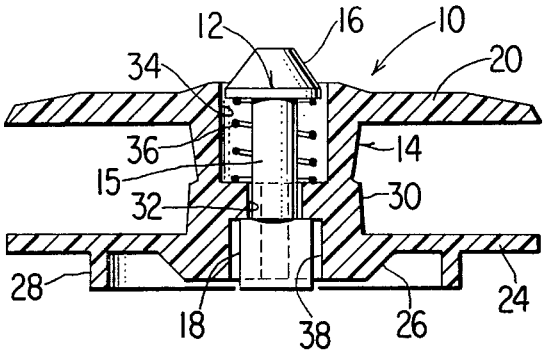
FIG. 1 is a vertical sectional view taken through a bobbin and plunger assembly according to the invention and showing the plunger in an unactuated position.

Referring to the drawings, reference character 10 designates an assembly according to the invention including a one-piece plunger 12 and a one-piece bobbin 14. The plunger includes a cylindrical shaft 15 with a control button 16 at one end, and a flat driving paddle 18 at the other end. The bobbin includes a top flange 20 formed with an outwardly extending slot 22 skewed from a true radial position on the top flange. The bobbin further includes a bottom flange 24 with a depending boss 26 to extend into a bobbin case aperture, and a protruding annulus 28 to rest on a supporting surface of the bobbin case.

As shown, the bobbin includes an intermediate section 30 with a through cylindrical opening 32 wherein plunger shaft 15 is supported. The bobbin is formed with a topside button accommodating recess 34 which communicates with opening 32, and wherein a coil spring 36 acts to bias plunger 12 upwardly in the bobbin. A pair of mutually perpendicular crossed slots 38 and 40 extend upwardly from the bottom of the bobbin. One slot 38 wherein the paddle 18 is normally located is dead ended, and so provides a stop 42 limiting upward movement of plunger 12. The other slot 40 extends to recess 34 and enables the paddle and bobbin to be assembled as described hereinafter without disturbing the structural integrity of the parts. The bobbin is preferably a molded plastic member.

Figure 2:
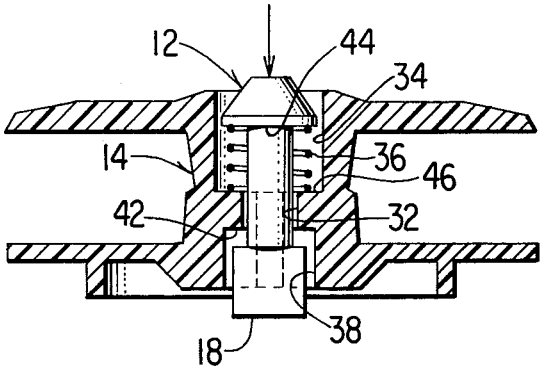
FIG. 2 is a view similar to FIG. 1, showing the plunger in an actuated position.
Figure 3:
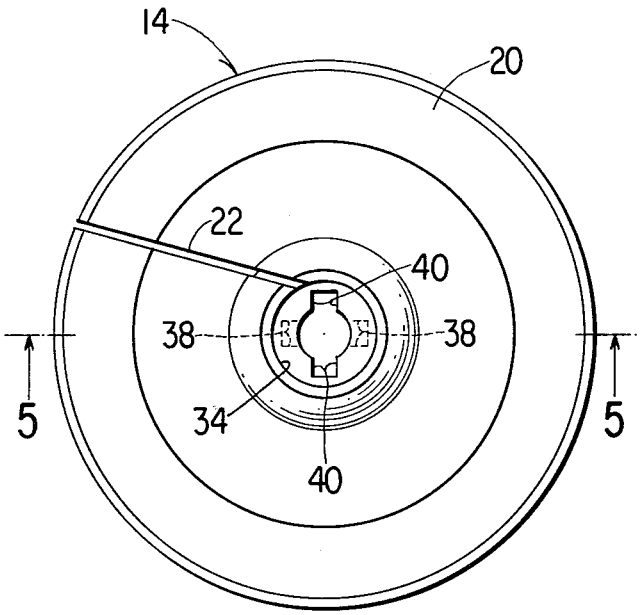
FIG. 3 is a top plan view of the bobbin alone.
Figure 4:
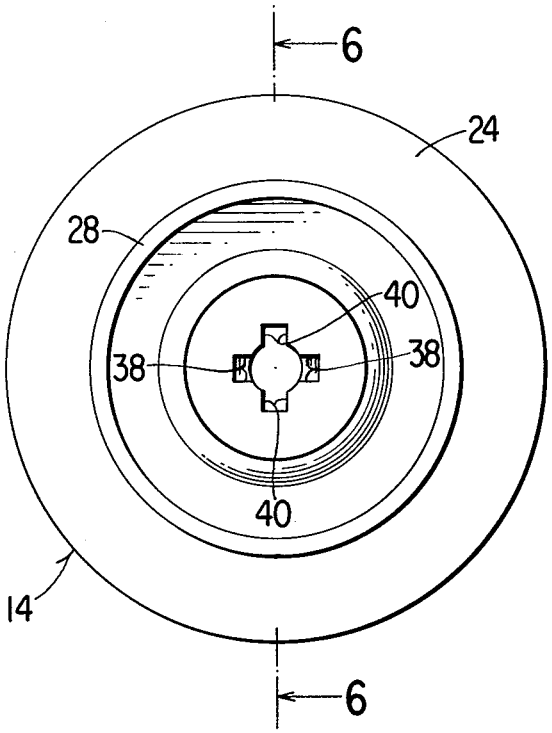
FIG. 4 is a bottom view of the bobbin of FIG. 3.
Figure 5:
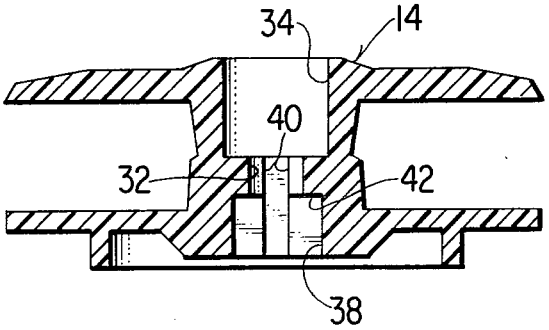
FIG. 5 is a sectional view taken through the bobbin on the plane of the line 5—5 of FIG. 3.
Figure 6:
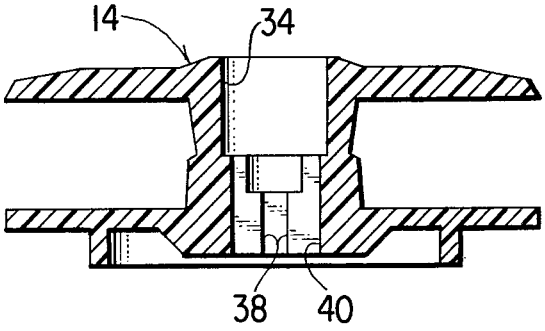
FIG. 6 is a sectional view taken through the bobbin on the plane of the line 6—6 of FIG. 4.
Figure 7:
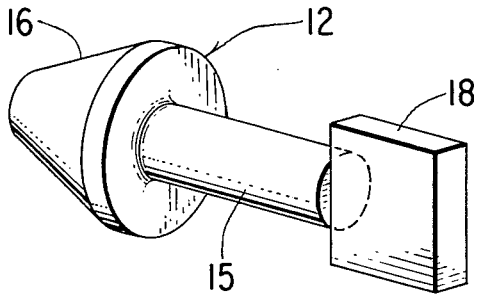
FIG. 7 is a perspective view of the plunger.

The normal spring biased position of plunger 12 is one in which the control button 16 projects at least in part above the top flange 20 of bobbin, and the paddle 18 is almost entirely within slot 38 (see FIG. 1). In the bobbin winding system of a sewing machine as described in the aforementioned U.S. Pat. No. 4,326,474, the plunger is moved downwardly in the bobbin by the engagement of a slide plate cam with control button 16, and is caused to assume a position (FIG. 2) wherein part of the paddle 18 extends below the bobbin to engage driving mechanism effective to rotate the paddle and thereby the bobbin for bobbin winding.

Figure 8:
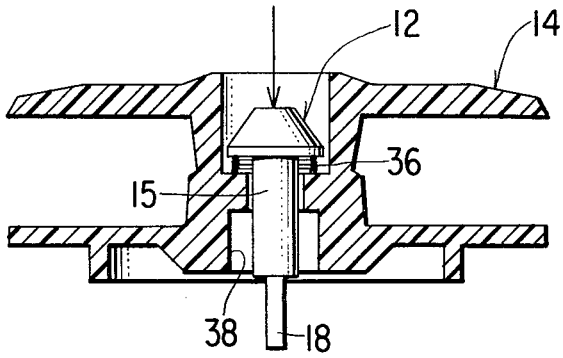
FIG. 8 is a sectional view through the bobbin on the plane of the line 5—5 of FIG. 3, but showing the plunger fully depressed therein.

Although the plunger 12 and bobbin 14 are one-piece structures, and the diameter of through opening 32 is less than either the width of paddle 18 or the maximum diameter of button 16, the plunger can nevertheless be conveniently located in its operating position in the bobbin during manufacture of the bobbin and plunger assembly. Spring 36 is first located about plunger shaft 15 by being expanded over the paddle 18 or control button 16, after which the plunger is inserted downwardly into the bobbin. The paddle after moving through recess 34 is aligned with slot 40 and moved downwardly through such slot with the application of force to button 16 as the spring 36 is compressed between the underside 44 of the button 16 and the bottom surface 46 of recess 34. The plunger is moved sufficiently far downwardly in the bobbin to project the entire paddle 18 beyond the bottom of the bobbin and so remove the paddle from slot 40 (FIG. 8). The paddle is then grasped and used to turn the plunger into a position wherein the paddle is aligned with slot 38. Once the paddle has been aligned with slot 38, the paddle is released, whereupon the plunger is moved upwardly in the bobbin by spring 36 until the upper end of the paddle engages stop 42. The plunger is then in its normal use position (FIG. 1) from which it may be depressed for bobbin winding.

A particular embodiment of the invention has been shown and described by way of illustration. However, other modifications will occur to those skilled in the art, and it is to be understood that it is intended to cover all changes and modifications falling with the true spirit and scope of the invention as set forth in the annexed claims.

I claim:

1. In combination, a one-piece sewing machine bobbin and a one-piece bobbin winding plunger, the plunger including a cylindrical shaft, a control button at one end of the shaft and a flat bobbin driving paddle at the other end, the bobbin including an intermediate section with a cylindrical through opening wherein the shaft is supported, a topside button accommodating recess which communicates with said through opening and wherein a spring acts to bias the plunger upwardly in the bobbin, and a pair of crossed slots which extend upwardly from the bottom side of the bobbin, one of the slots having the paddle therein and beiing dead ended to provide a stop for the paddle limiting upward movement of the plunger, the other slot being formed to extend from the bottom of the bobbin to the button accommodating recess and permit the plunger to be assembled in the bobbin with an accompanying movement of the paddle down through the said other slot to a position below the bobbin from which the paddle can be turned into alignment with said one slot and caused by the spring to snap into the said one slot.

2. The combination of claim 1 wherein the crossed slots are mutually perpendicular.

3. The combination of claim 1 wherein the bobbin is a molded plastic member.

4. The combination of claim 1 wherein the spring extends between the underside of the control button and intermediate section of the bobbin.

* * * * *